US005483502A

United States Patent [19]

Scarpitta et al.

[11] Patent Number: 5,483,502

[45] Date of Patent: Jan. 9, 1996

[54] METHOD AND APPARATUS FOR EMITTING HIGH POWER ACOUSTIC WAVES USING TRANSDUCERS

[75] Inventors: Alain A. Scarpitta, Toulon; Didier Boucher, Six Fours Les Plaqes; Thierry Wintz, Toulon, all of France

[73] Assignee: Etat Francais represente par le Delegue General pour l'Armement, Paris, France

[21] Appl. No.: 353,361

[22] Filed: Dec. 2, 1994

[30] Foreign Application Priority Data

Dec. 3, 1993 [FR] France ..... 93 14502

[51] Int. Cl.[6] ..... H04R 17/00

[52] U.S. Cl. ..... 367/158; 367/159; 310/334

[58] Field of Search ..... 367/158, 159; 310/334

[56] References Cited

U.S. PATENT DOCUMENTS

| | | | |
|---|---|---|---|
| 3,624,429 | 11/1971 | Behrendt | 367/159 |
| 4,231,112 | 10/1980 | Massa | 367/158 |
| 4,972,390 | 11/1990 | Pagliarini, Jr. | 367/158 |
| 5,130,953 | 7/1992 | Grosso | 367/158 |
| 5,274,608 | 12/1993 | Graham | 367/158 |
| 5,363,345 | 11/1994 | Boucher et al. | 367/158 |

FOREIGN PATENT DOCUMENTS

| | | |
|---|---|---|
| 2665998 | 5/1988 | France . |
| 2663181 | 6/1990 | France . |

*Primary Examiner*—Charles T. Jordan
*Assistant Examiner*—Theresa M. Wesson
*Attorney, Agent, or Firm*—Oliff & Berridge

[57] ABSTRACT

A transducer includes at least one cylindrical driving assembly and at least one headmass coupled to an end of the cylindrical driving assembly. The headmass has an external ring that surrounds a core. The core is made from a core material that is less dense than the material from which the external ring is made. The headmass is dimensioned to occupy a predetermined volume so as to transmit waves within a predetermined frequency range. As a result, the transducer provides higher power waves, yet occupies the same volume as the transducers of the prior art.

20 Claims, 3 Drawing Sheets

METHOD AND APPARATUS FOR EMITTING HIGH POWER ACOUSTIC WAVES USING TRANSDUCERS

BACKGROUND OF THE INVENTION

The present invention relates to an apparatus and method for emitting high power acoustic waves.

The technical field of the invention is the building of electro-acoustic transducers.

The principal application of the invention is increasing the emitting power of an underwater transducer that consists of at least one headmass and a driving assembly.

Underwater electro-acoustic transducers, and in particular piezoelectric transducers, are known. Piezoelectric transducers include a rigid, hollow cylindrical shell, which is open at both axial ends. Within and along the axis of the shell, two identical electro-acoustic motors are arranged on either side of a central countermass. The opposite ends of the countermass are surrounded by a headmass. These transducers are called "Tonpilz" double type transducers. The electro-acoustic motors can be made of two piles of aligned piezoelectric wafers. The external faces of both headmasses are located in the plane of the shell axial ends, so that they are in contact with the liquid in which the shell is immersed. The external perimeter of these headmasses is very close to the edge of the open axial ends of the shell.

Thus, these external faces emit acoustic waves in the liquid when the electro-acoustic motors are electronically excited. These transducers are used to emit low frequency acoustic waves in water and in a given direction, as disclosed in French patent application FR 2 663 181, which describes additional devices that provide increased power.

To avoid the propagation of the acoustic waves emitted by the rear faces of the headmasses inside the shell, especially when the shell is filled with liquid, which results in the acoustic waves being retransmitted in the ambient medium despite the rigidity of the shell, various devices have been used. These devices include elastic tubes which are watertight and filled with gas and are located in the cavity filled with ambient liquid at the rear part of the headmasses. The devices are such that the frequency of the Helmholtz resonance of the cavity is close to the fundamental frequency of the axial vibrations of the vibrating assembly as disclosed, e.g., in French patent FR 2 665 998.

Thus, the problem of the resistance to the external shell pressure is transferred to the resistance of the elastic tubes, which, because they have smaller diameters, make a lighter assembly possible. Other devices, however, can be developed within the same scope of the invention.

These devices require keeping a large enough cavity behind the headmass. When an increase in transducer power is desired, the volume of the electro-acoustic motors increases, which results, on the one hand, in an elongation of the electro-acoustic motors and, on the other hand, an increase in the rigidity and coefficient of the electromechanical coupling between the motors and the headmass. However, it is then necessary to increase the external space required for the transducer as well as its weight. If this is not accomplished, on the one hand, sufficient space will not be available to provide suitable means in the central cavity such as they are described above, and on the other hand, the amount of converted power will be lower.

Moreover, even if there are no disadvantages to increasing the weight and space required, the transducer pass band is narrower and lower than for a standard transducer. As a result, the transducer does not meet the needs of the desired application.

The stated problem is to be able, starting from a transducer having at least one driving assembly and at least one headmass dependent on the driving assembly, and with a given volume, to increase its power by at least 50% while remaining in a range of emission frequencies corresponding to that of the standard transducer having the same volume.

SUMMARY OF THE INVENTION

A solution to the stated problem is an apparatus and method of emitting high power acoustic waves from a transducer such as the one mentioned above, in which the transducer includes at least one cylindrical driving assembly and at least a headmass having the dimensions and an external volume determined so as to transmit waves in a particular frequency range and at given power. The end of the assembly is configured such that:

- the coupling between the assembly and the headmass is ensured by a core made of rigid material, located in the headmass center;
- the external ring surrounding the core is made of a lighter material than the core and makes up the remainder of a predetermined volume; and
- the transducer power of emission is increased for the same given frequency range.

In a preferred embodiment, in order to obtain higher efficiency and an increase in power, the assembly is embedded in the core and the same external transducer volume is maintained, but the assembly is lengthened.

An objective of the invention is also reached by an acoustic wave emitting transducer headmass having at least one cylindrical driving assembly, an end of which is dependent on the headmass. The headmass includes a central core, made of rigid material, that ensures coupling with the end of the assembly, and an external ring surrounding the core and made of material lighter than the core.

In a preferred embodiment, the end of the assembly is embedded in the core, and preferably, the ring is made of aluminum or an aluminum alloy. The ring makes up 65 to 85% of the volume of the headmass, and the core is made of steel or a steel alloy to fill the remaining volume of the headmass.

As a result, the present invention provides a new method for emitting high power acoustic waves, and a new transducer headmass for emitting such acoustic waves.

These methods and headmasses respond to the various disadvantages previously mentioned in the discussion of conventional transducers that arise when increased power is desired. These methods and headmasses make it possible to solve the stated problem and reach the fixed objectives.

It is well known that the power emitted by a transducer depends partly on the quantity of ceramics, and partly on the square of the number of the coefficient of electromechanical coupling between the headmass and the electro-acoustic motor that causes it to vibrate. The coefficient of electromechanical coupling itself depends on the shape of the assembly and headmass, on its elasticity, on the central mass and on its assembly, bearing in mind that a primary factor is the elasticity of the headmass.

If the headmass is too elastic, a significant loss of energy by deformation results, and if it is too rigid, it will be too heavy, thus reducing the frequency pass bands and shifting the frequency toward lower frequencies, which does not correspond to the objectives of the invention.

In the present invention, the choice to build a headmass made of two materials, preferably metallic, with a rigid central core and a light peripheral ring, yields a rigidity sufficient enough to produce a better coupling efficiency because of the core. At the same time, to have a headmass that is light as a whole because of the ring, which keeps the desired frequency and pass band, is also possible.

Lightening the external ring is important because, at this point, the volume, and therefore the corresponding weight, are maximum.

It is also known that the parasitic frequency due to the deformation and elasticity of the headmass, is a function of $\sqrt{E/r}$, where r is the material density and E is the modulus of elasticity for the material. To minimize the loss of energy due to this deformation, this same frequency must be out of the range of the transducer frequency. Because the E/r ratio is constant for all the metal materials, this resonance frequency is not modified by the choice of material having a low density, particularly because the central core is reinforced by a rigid part that can be adapted to whatever shape the headmass may be. Therefore, the rigidity of the assembly can be improved. If the volume and bulkiness of a heavy single-material headmass are equal, it is possible to lighten the headmass to keep the same resonance frequency, and therefore the same possible working frequencies, while lightening the assembly and increasing the power transferable by the headmass.

Because the present invention has the same bulkiness as a standard transducer, the internal volume of the rear cavity is kept in order to place equipment such as baffles or other closed elastic tubes, which are required for the assembly to perform.

In a preferred embodiment previously indicated, the assembly is embedded in the headmass. The rigid and resistant central core allows deeper embedding than a lighter material, which could generate parasite modes of frequencies and which would not withstand the impact of compression by the assembly.

The presence of this central rigid material makes it possible to leave the core in direct contact with the medium, thus ensuring a thermal bridge to discharge the calories emitted by the electro-acoustic motors, since any rigid material is more resistant than the light materials which are more likely to oxidize. Other advantages of the present invention could be mentioned, but the above-mentioned ones are sufficient to demonstrate its novelty and interest.

BRIEF DESCRIPTION OF THE DRAWINGS

The description and figures hereafter show an example of a prototype of the invention, but they have no limiting character; it is possible to build it otherwise within the framework of the range and extent of the invention, particularly by changing the nature of the materials composing the headmass, which could be selected from among composite materials and not only metallic ones.

The present invention can apply to all types of transducers, even if in the below-mentioned example, in order to simplify the description and taking into account that it relates to the principal application of the invention, only transducers in which a headmass is coupled to electro-acoustic transducer motors, "Tonpilz" double type with a cylindrical shape of revolution, are described.

Figure 1:
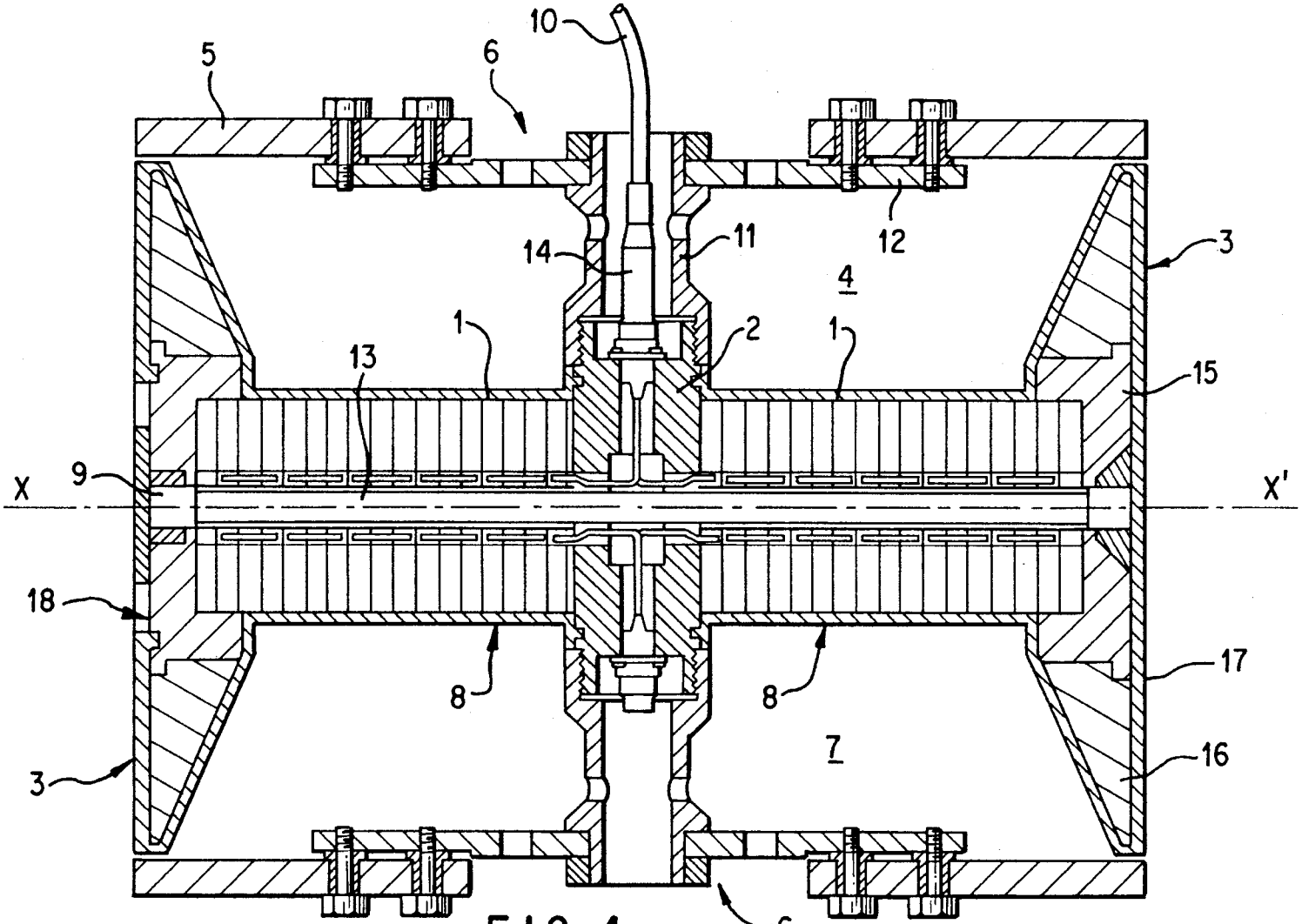
FIG. 1 is an axial cutaway view of a transducer of the previously mentioned type, and fitted with headmasses according to the invention.

The transducer as it is represented in a cutaway view in FIG. 1, includes as known, two electro-acoustic motors 1, aligned on an axis xx' located on both sides of a central countermass 2 and coaxially inside a cylindrical shell 5, that can be called the external shell, and that covers all the motors 1 up to their end headmass 3. The cavity 7 is thus delimited by the headmasses, and the shell is filled with liquid 4, such as sea water, in which the transducer is immersed.

The electro-acoustic motors 1 and the intermediate mass 2 are held together by a prestressed rod 9 that immobilizes both headmasses 3 and various connecting parts 11. The connecting parts are connected to various fixing parts 12 that connect the electro-acoustic motors to the external shell 5. The fixing parts allow free motion of both the electro-acoustic motor ends on the headmass side and the headmasses 3 themselves, relative to the shell 5, to ensure the full emission of acoustic waves in the ambient medium.

An internal sheath 13 isolates the prestressed rod from the motors 1, and an external sealing envelope 8 insulates these motors 1 from the ambient medium 4.

The electro-acoustic motors 1 are supplied by a feeder cable 10 fixed on the connecting parts 11 by an electric connector 14. The fabrication of such a transducer and all the various connecting parts that constitute it is known and can be carried out by anyone skilled in the art. The other elements that make it possible to obtain, in particular, a Helmholtz resonance frequency of the cavity as indicated above, as well as to improve the mechanical structure of the assembly are known, and, therefore, are not shown here.

To make it possible to fill the cavity 7, with the liquid 4, the internal shell 5 includes at least one opening 6 to communicate with the outside. The opening preferably has holes distributed around the cylindrical part of the shell, or even a complete circular peripheral opening. Moreover, because cavity 7 is not water-tight and communicates with the outside, the end headmasses 3 are not connected at their periphery to shell 5, and can thus move freely.

According to the invention, each of the headmasses 3 includes a central core 15 made of rigid material, ensuring the coupling with the end of the assembly of electro-acoustic motors 1, and an external ring 16 surrounding the core 15. The ring is made of a material lighter than the core material.

Moreover, both ends of the assembly of electro-acoustic motors 1 can be embedded in each of the cores 15 of headmasses 3. Embedding part of the ceramic disks in the headmasses does not modify the coupling coefficient significantly because, on the one hand, the electro-acoustic engine elasticity is increased, thus increasing this coefficient and, on the other hand, the particular shape of the headmass obtained increases the parasite elasticity and reduces this coefficient.

However, embedding makes it possible to increase the ceramics volume for an equivalent length and external bulkiness of the transducer.

However, the power supplied by a transducer is proportional to the product: $V_c$ (ceramics volume)×$F_r$ (resonance frequency)×$K^2$ (electromechanical coupling coefficient). Therefore, with an embedded assembly, a higher power will be obtained with a constant bulkiness.

In FIG. 1, the core 15 is represented as being cylindrical and having the same axis as that of the electro-acoustic motors 1, but the core 15 could have other shapes, such as truncated shapes.

Because the core 15 is made of rigid material, preferably stainless steel, the core 15 could be put in direct contact with the ambient medium to allow for the thermal exhaust of the calories of electro-acoustic motors 1, as they are represented on the left part of FIG. 1. In this case, the external envelope 17 that protects the whole headmass is open around axis xx' of the transducer to leave a surface 18 of core 15 in contact with the outside.

Figure 2:
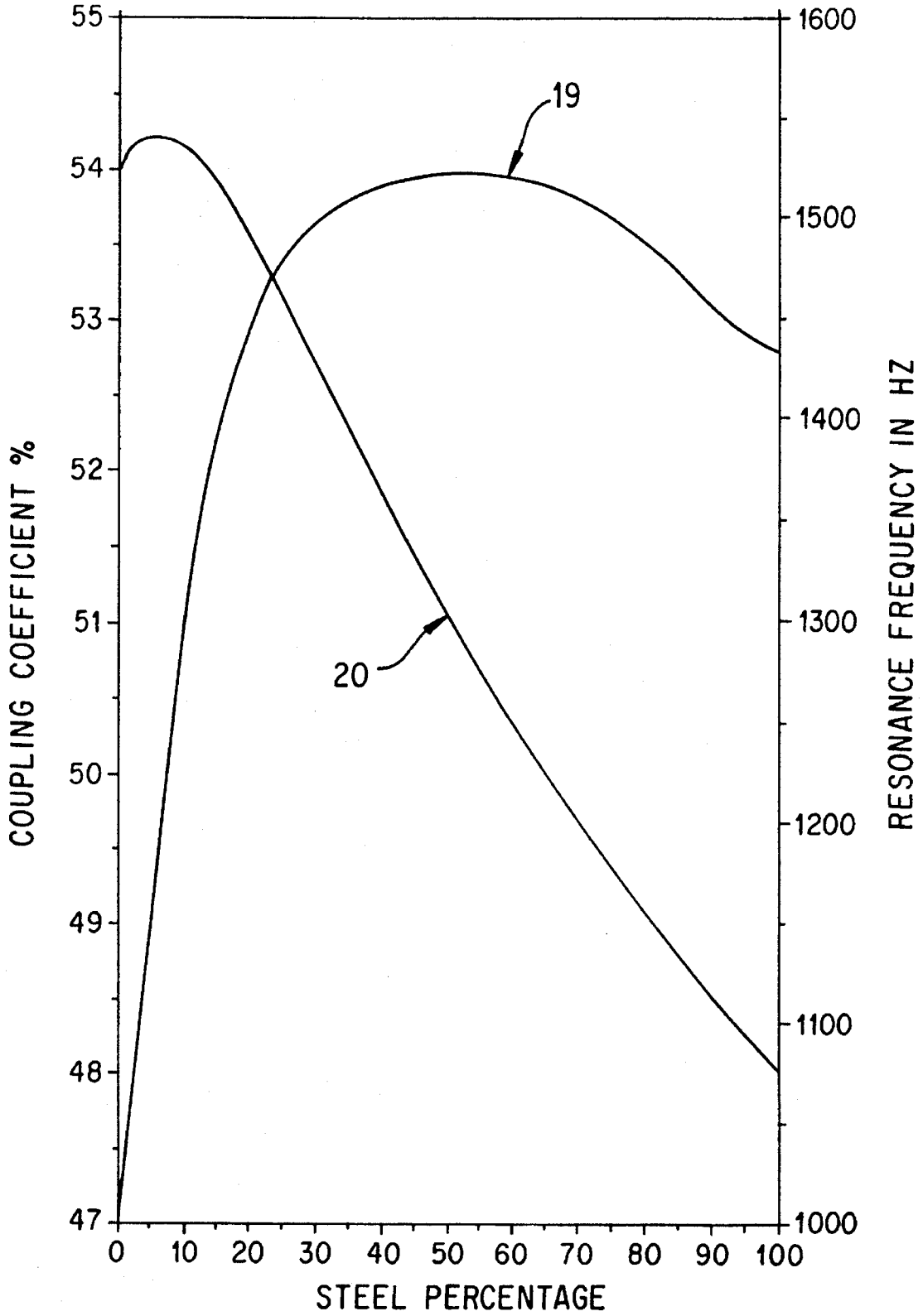
FIG. 2 is a graph that shows the coefficient variation curves of the coupling and resonance frequency of headmasses depending on the percentage of steel in the total volume of the headmass.

In order to optimize the percentage of light material in ring 16 compared to the whole volume of headmass 3 and that of rigid core 15 compared to this same volume, various relationships can be shown. As seen in FIG. 2, curves of a standard length transducer, such as, for instance a 570 mm length transducer of a standard construction and having a resonance frequency of approximately 1,658 Hertz and a coupling coefficient of 48.84% can be shown. With an embedded assembly and for a range of percentages of "25C" type steel, for core 15, depending on the total volume of headmass 3, FIG. 2 shows:

resonance frequency curve 20 depending on the percentage, and the coupling coefficient curve 19 depending on the same percentage.

These curves confirm what is mentioned among the disadvantages of the existing systems. In other words, the presence of steel stiffens the structure and thus allows for an increase in the electromechanical coupling coefficient. If the resonance frequency is taken into account, however, the mass supply of the headmass substantially decreases the resonance frequency, thus resulting in total power loss, even if the length of the transducer is increased, according to the previously indicated power formula, depending on the volume of ceramics, the frequency and the coupling coefficient.

For headmasses with a high volume steel core, that is to say, over 70%, a decrease of the coupling coefficient is observed, since the mass effect of the headmass end results in a light agitation.

Figure 3:
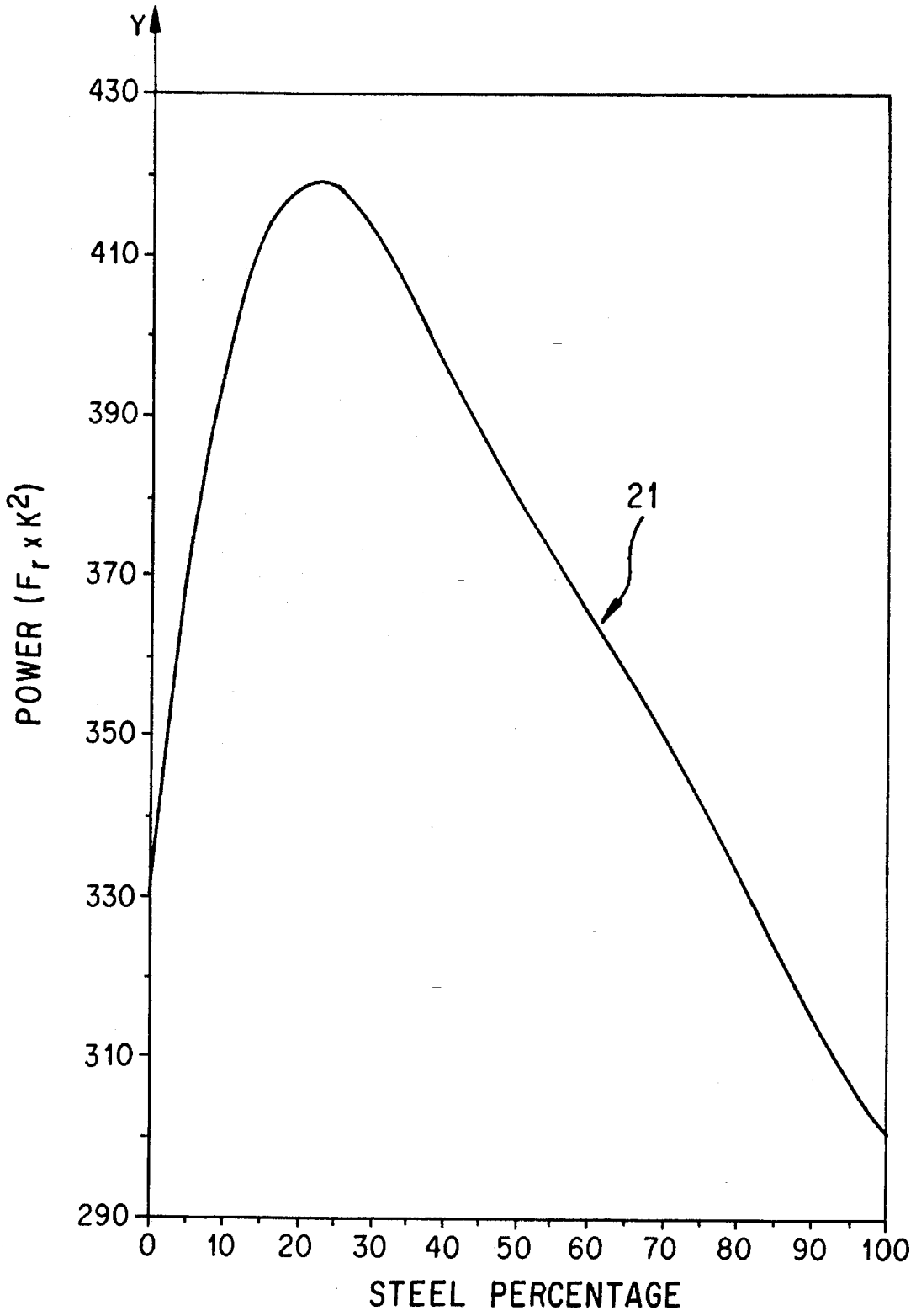
FIG. 3 is a graph that shows the course of the product of the resonance frequency and square number of the coupling coefficient of FIG. 2, depending on the percentage of steel in the headmass total volume.

Using these two curves, it is possible to draw the power course that depends on the product $F_r \times K^2$ for a given volume of ceramics, as shown in curve 21 in FIG. 3. In the example represented, maximum power is obtained for a central core having 21% steel relative to the total volume of the headmass.

On his curve, an increase of more than 25% of the acoustic power is obtained, starting from a level of power that is itself increased by approximately 30%, due also to the embedding of motors 1 in headmass 3, and thus it is possible to obtain a power gain of more than 50% compared to a transducer having the same length and bulkiness but being constructed of only a single material and not having embedded motors 1.

In other embodiments, with the use of other metallic or composite materials, the volume percentages of the core 15 and the ring 16 can be different, but preferably, when the ring 16 is made of aluminum or aluminum alloy, its volume is 65% to 85% of the total volume of headmass 3. In this case, the core 15 is preferably made from steel or steel alloy, such as the "25CD4" referred to above, and the core 15 fills the remaining volume of the headmass 3, i.e. the core fills 35–15%, respectively.

Aluminum, or rather aluminum alloy, for example of the "AU4G" type and its percentage in volume constituting the ring 16, is preferably 75 to 85% of the total volume of the headmass 3.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

We claim:

1. A transducer that emits high power acoustic waves, comprising:

at least one cylindrical driving assembly; and at least one headmass coupled to an end of the at least one cylindrical driving assembly, the headmass having an external ring that surrounds a core, the external ring being made from an external ring material and the core being made from a core material that is more dense than the external ring material, wherein the headmass occupies a predetermined volume such that the transducer transmits waves in a predetermined frequency range.

2. The transducer of claim 1, wherein the end of the at least one cylindrical driving assembly is attached to the core of the headmass.

3. The transducer of claim 1, wherein the external ring material includes aluminum.

4. The transducer of claim 3, wherein about 65% to about 85% of the volume of the headmass is occupied by the external ring.

5. The transducer of claim 3, wherein the core material includes steel.

6. The transducer of claim 5, wherein about 15% to about 35% of the volume of the headmass is occupied by the core.

7. The transducer of claim 1, wherein the core is substantially cylindrical.

8. The transducer of claim 7, wherein the core is coaxial with the cylindrical driving assembly.

9. The transducer of claim 1, wherein the core is truncated.

10. The transducer of claim 9, wherein the core is coaxial with the cylindrical driving assembly.

11. The transducer of claim 1, wherein at least part of an external surface of the core is in direct contact with an ambient liquid.

12. The transducer of claim 1, wherein the core is made from a rigid material, and the end of the cylindrical driving assembly is embedded in the core.

13. The transducer of claim 12, wherein the external ring material includes aluminum.

14. The transducer of claim 13, wherein about 65% to about 85% of the volume of the headmass is occupied by the external ring.

15. The transducer of claim 13, wherein the core material includes steel.

16. The transducer of claim 15, wherein about 15% to about 35% of the volume of the headmass is occupied by the core.

17. The transducer of claim 12, wherein the core is cylindrical.

18. The transducer of claim 12, wherein the core is truncated.

19. A headmass for use in a transducer having a cylindrical driving assembly, the headmass comprising:

a core made from a core material; and an external ring that encircles the core, wherein the core material is less dense than a material from which the external ring is made, wherein the headmass occupies a predetermined volume such that the transducer transmits waves in a predetermined frequency range.

20. A method of emitting high power waves in a liquid using a transducer, the transducer being connected to a power source and having at least one cylindrical driving assembly and at least one headmass coupled to an end of the cylindrical driving assembly, the method comprising the steps of:

providing an external ring that surrounds the core of the headmass, the core being made from a material that is more dense than a material from which the external ring is made;

embedding said at least one cylindrical driving assembly within said core of said headmass; and producing the high power waves by operating the transducer while the headmass is at least partially in contact with the liquid.

* * * * *